US012655592B2

(12) United States Patent
Mikhelson et al.

(10) Patent No.: US 12,655,592 B2
(45) Date of Patent: Jun. 16, 2026

(54) METHOD FOR FABRICATING A GRAVITY-BASED STRUCTURE (GBS) AT A SPECIALIZED FABRICATION SITE

(71) Applicant: Publichnoe Aktsionernoe Obshchestvo "NOVATEK", Tarko-Sale (RU)

(72) Inventors: Leonid Viktorovich Mikhelson, Moscow (RU); Valeriy Nikolaevich Retivov, Moscow (RU); Sergey Gennadyevich Solovyev, Novyy (RU)

(73) Assignee: Publischnoe Aktsionernoe Obshchestvo "NOVATEK", Tarko-Sale (RU)

( * ) Notice: Subject to any disclaimer, the term of this patent is extended or adjusted under 35 U.S.C. 154(b) by 102 days.

(21) Appl. No.: 18/728,584

(22) PCT Filed: Oct. 14, 2022

(86) PCT No.: PCT/RU2022/000312
§ 371 (c)(1),
(2) Date: Jul. 12, 2024

(87) PCT Pub. No.: WO2023/158337
PCT Pub. Date: Aug. 24, 2023

(65) Prior Publication Data

US 2025/0109561 A1 Apr. 3, 2025

(30) Foreign Application Priority Data

Feb. 15, 2022 (RU) ..... RU2022103801

(51) Int. Cl.
*E02D 27/52* (2006.01)
*E02B 17/02* (2006.01)

(52) U.S. Cl.
CPC ..... *E02B 17/025* (2013.01); *E02D 27/52* (2013.01); *E02D 2250/0023* (2013.01);
(Continued)

(58) Field of Classification Search
CPC . E02D 2250/0023; E02D 27/52; E02D 27/42; E02D 27/425; B63B 35/44;
(Continued)

(56) References Cited

U.S. PATENT DOCUMENTS 10,822,760 B2 * 11/2020 Berenguer ..... E02B 17/02
2012/0047830 A1 * 3/2012 Phuly ..... E02B 17/025 52/294
2022/0324541 A1 10/2022 Kanayama et al.

FOREIGN PATENT DOCUMENTS

KR 10-2015-0023161 A 3/2015
KR 20150136823 A 12/2015
(Continued)

OTHER PUBLICATIONS

International Search Report in PCT/RU2022/000312, mailed Mar. 2, 2023.
(Continued)

*Primary Examiner* — Sean D Andrish
(74) *Attorney, Agent, or Firm* — Collard & Roe, P.C.

(57) ABSTRACT

A gravity-based structure (GBS) includes central and protruding parts having a common base slab. For the central part, outer and inner walls and a top slab are cast in concrete so that the GBS forms a rectangular prism. As casting of individual outer wall sections is completed, a reinforcement cage is assembled, formwork is installed, and protruding part outer and inner walls are cast, the outer walls being formed along the base slab perimeter with a height lower than the central part outer wall height. As separate protruding part wall sections are cast, a reinforcing cage is assembled, formwork is installed for a protruding part top slab, and then cast. Post-tensioning of central part base and top slabs and central and protruding part outer and inner walls is done as central and protruding part top slab casting
(Continued)

Figure 1:
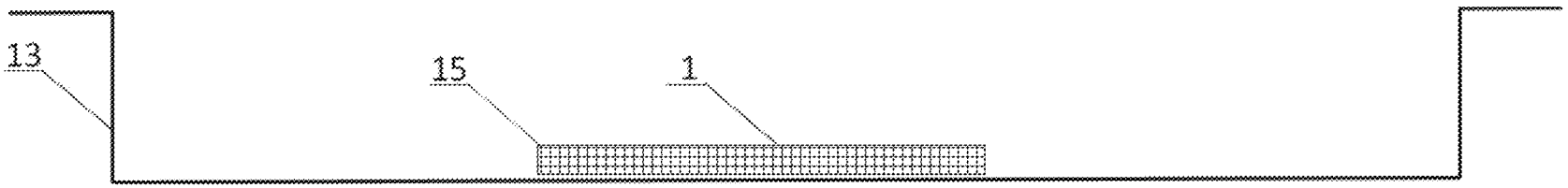

is completed and the concrete is cured, increasing buoyancy and reducing submersion.

5 Claims, 7 Drawing Sheets

(52) U.S. Cl.
CPC ..... *E02D 2250/0046* (2013.01); *E02D 2300/002* (2013.01); *E02D 2300/0029* (2013.01)

(58) Field of Classification Search
CPC ..... E02B 17/02; E02B 17/025; E02B 2017/0091; E02B 2017/0039; E02B 2017/0069
See application file for complete search history.

(56) References Cited

FOREIGN PATENT DOCUMENTS

| | | | |
|---|---|---|---|
| KR | 10-2018-0051852 A | | 5/2018 |
| WO | WO 2020/153839 | * | 7/2020 |
| WO | 2021/106151 A1 | | 6/2021 |

OTHER PUBLICATIONS

Waters Lisa B. et al., Design and Construction on Gravity Based Structure and Modularized LNG Tanks for the Adriatic LNG Terminal. ExxonMobil Development Company, 2007, [online] [retrieved on Dec. 22, 2022]. Retrieved from <http://www.ivt.ntnu.no/ept/fag/tep4215/innhold/LNG%20Conferences/2007/fscommand/PS6_7_Waters_s.pdf>, total of 29 pages.

Gyetvay Mark, CFO and Deputy Chairman of the Management Board and Alexander Nazarov, Head of Investor Relations, "A Major New Player: Expanding Our Global LNG Footprint From 2018 to 2030", Sberbank CIB—"Russia: The Inside Track" Conference Moscow, May 22-23, 2018 [online] [retrieved on Dec. 22, 2022]. Retrieved from <https://www.novatek.ru/common/upload/doc/IR_May_2018_.pdf>, p. 13-16, total of 36 pages.

Tistel Joar et al, "Gravity Based Structure Foundation Design and Optimization Opportunities", Proceedings of the Twenty-fifth (2015) International Ocean and Polar Engineering Conference, Kana, Big Island, Hawaii, USA, Jun. 21-26, 2015 [online]. Retrieved from <https://www.researchgate.net/publication/282605135_Gravity-Based Structure Foundation Design and Optimization Opportunities>, total of 9 pages.

Widianto et al., "Concrete Gravity-Based Structure, Construction of the Hebron offshore oil platform", [online] Jun. 2016, V. 38, No. 6, Retrieved from <https://www.concrete.Org/Portals/O/Files/PDF/hebron_platform_sl9.pdf>, total of 9 pages.

International Search Report in PCT/RU2022/000310, mailed Feb. 9, 2023.

Unlocking Our Arctic Resources: Decarbonizing Our Footprint. Think Green. Think Natural Gas. Energy Affordability, Security & Sustainability Investor Meeting, May 2021, [online] [retrieved on Dec. 22, 2022]. Retrieved from <https://www.novatek.ru/common/upload/doc/IR_May_2021_Investor_Meetings_updated.pdf>, total of 50 pages.

* cited by examiner

METHOD FOR FABRICATING A GRAVITY-BASED STRUCTURE (GBS) AT A SPECIALIZED FABRICATION SITE

CROSS REFERENCE TO RELATED APPLICATIONS

This application is the National Stage of PCT/RU2022/000312 filed on Oct. 14, 2022, which claims priority under 35 U.S.C. § 119 of Russian Application No. 2022103801 filed on Feb. 15, 2022, the disclosure of which is incorporated by reference. The international application under PCT article 21(2) was not published in English.

TECHNICAL FIELD

The invention pertains to fabrication (construction) of gravity-based structures (GBS) and can be used as part of development of various kinds of near-shore and offshore production (including natural gas liquefaction, ammonia, methanol, hydrogen production, and power generation), transportation, transshipment, and storage facilities.

BACKGROUND ART

A gravity-based structure (GBS, a fixed gravity-based offshore platform) is a platform, which is fixed on a seabed with the help of its own weight. Gravity-based structures are used in coastal and shelf waters where the water depths are sufficient to support a superstructure of the required height above the water level once the GBS is installed on the seabed. A GBS can feature internal compartments to enable its floatability during transportation to its installation site. GBSs are designed to be floatable and have ballasting systems to enable long-distance transportation and installation for operation at the intended offshore site without using expensive lifting and transportation equipment. GBSs are mostly made of reinforced concrete and steel.

GBSs are produced at production sites and shipyards that have special equipment.

There exists a method for fabricating a gravity-based structure (GBS) made from reinforced concrete to support a floating power plant and store liquefied natural gas which has a form of a rectangular prism with a base slab, a top slab, and side walls. The method consists in placing reinforcement bars, concreting the GBS elements, and performing pre-stressing and post-tensioning of the GBS elements (KR20150136823A, publication date: Dec. 8, 2015).

A method, which is the closest to the proposed one, features a gravity-based structure (GBS) fabrication for Adriatic LNG, an offshore liquified natural gas receiving and regasification terminal built at Algeciras' production site in Spain (Design and Construction on Gravity Based Structure and Modularized LNG Tanks for the Adriatic LNG Terminal. Lisa B. Waters et al. ExxonMobil Development Company. 2007. http://www.ivt.ntnu.no/ept/fag/tep4215/innhold/LNG%20Conferences/2007/fscommand/PS6_7_Waters_s.pdf.)

This GBS is made in a form of a rectangular prism with a top slab, a base slab, an intermediate support slab for self-supported LNG tanks, external walls, internal longitudinal and transversal walls to separate the compartments.

The above production method features the following:

a GBS construction site is prepared, including installation of concrete cavities for steel skirts and installation of these steel skirts, in this case the skirts hang loose in the concrete cavities in such a way that the GBS weight is shifted to the site backfilled with gravel and to the concrete foundations;

a rectangular reinforcement cage is assembled for the base slab, formwork for the base slab is installed and the base slab is then concreted;

once concreting of individual base slab areas is completed, reinforcement cages for the external and internal walls are assembled and the external and internal walls are slip-formed except the short-end walls on one of the GBS sides (on the side where the LNG tanks were installed);

simultaneously with walls concreting, a reinforcement cage for the intermediate slab is assembled, formwork is erected and the intermediate slab is concreted;

roof beams are fabricated and installed;

as separate wall sections are concreted, a reinforcement cage for the top slab is assembled, the top slab formwork is installed and then the top slab is concreted, insulation and second barrier for LNG tank compartments are installed;

sections for self-supporting LNG tanks are erected;

the short-end walls on one of the GBS sides are concreted (on the side where the LNG tanks are installed);

the top slab and base slab, as well as inner and outer walls are post-tensioned with the reinforcement strands.

This method has the following drawbacks.

Installation of concrete cavities for steel skirts and steel skirts increases the scope and duration of works at a preparatory stage, presence of concrete cavities makes preparation of the foundation more complicated.

Use of roof beams complicates construction works and requires use of cranes with higher carrying capacity.

Concreting of the short-end walls on one side of the GBS (on which the LNG tanks are installed) is carried out the last after the tanks are installed in the GBS compartments, which increases the construction time and violates monolithic nature of the reinforced concrete structure due presence of "cold joints" in this section.

The rectangular prism-shaped GBS has large draft when transported to the installation site, which makes transportation through shallow water areas impossible.

The rectangular prism-shaped GBS is not protected from external influences such as ice drift and emergency ship impact.

SUMMARY OF THE INVENTION

The technical problem resolved with the invention is as follows. Taking into account the increasing share of production and infrastructure facilities located in underdeveloped areas, including coastal and water area of Arctic seas, there is an urgent need to develop a new and efficient method for construction of gravity-based structures which could house production, transportation, transshipment and storage complexes for various purposes in the coastal and water areas and adapted for use in water areas with ice conditions.

To resolve the above-said problem, there was proposed a method for producing a GBS representing a three-dimensional reinforced concrete structure with internal walls separating compartments and aimed for installation on a bottom of a water object and which may serve as a foundation to accommodate a topside for various purposes. Besides, the GBS may stay floating during its transportation though water routes from a production location to an installation location, and when installed on a seabed, it can resist ice loads from an iced basin. The topside can be erected either immediately after the GBS production or after the GBS placement onto a seabed or at one of the interim locations during the GBS transportation from the production location to the installation location.

The technical issue is solved by a method of a gravity-based structure (GBS) production, meaning that

- a reinforcement cage is assembled for a rectangular base slab, a base slab formwork is installed and the base slab is then concreted,
- as separate sections of the base slab are concreted, reinforcement cages for inner and outer walls are assembled and concreted with slipforming,
- as separate wall sections are concreted, a reinforcement cage for top slab is assembled, a top slab formwork is installed and then the top slab is concreted,
- the top slab and base slab, as well as inner and outer walls are post-tensioned with reinforcement strands,
- along with that, as per the invention,
- the GBS is fabricated, including a central part and a protruding part that have the common base slab,
- inner and outer walls as well as the top slab are concreted for the central part of GBS, that takes form of a rectangular prism,
- as separate sections of the outer walls of the central part are concreted, a reinforcement cage is assembled, a formwork is installed and concreting is performed for inner and outer walls of the GBS protruding part, the outer walls of which are made along a perimeter of the base slab, and at the same time height of the outer walls of the protruding part is lower than height of the 15 outer walls of the central part,
- as separate wall sections of the protruding part are concreted, a reinforcement cage is assembled and a formwork is installed for the top slab of the protruding part and then concreted,
- and the base and top slabs of the central part, as well as the inner and outer walls of the central part and protruding part are post-tensioned as the top slabs of the central part and protruding part are concreted and the concrete of the post-tensioned structures gains required strength.

In addition, it is advisable to concrete the top slab with upward bending of its central part so that the central part of the top slab lowers later on its own weight to a design position.

Moreover, in the preferred option of the invention, as separate sections of the top slab of the central part are concreted, a reinforcement cage is assembled, a formwork is installed, embedments are set and supports for equipment are concreted on the top slab.

Furthermore, as the outer and inner walls of the central part are concreted, it is advisable to leave openings for formwork removal and further installation of equipment inside the GBS compartments shaped by the walls and slabs.

Should it be required to accommodate at least one tank for storage of liquid in the GBS, then simultaneously with concreting of the walls of the central part, a reinforcement cage is assembled, a formwork is installed and an intermediate slab is concreted, post-tensioned, and inside at least one compartment shaped by the walls, intermediate slab and top slab, a tank for storage of liquid is assembled from panels, delivered through the wall openings.

The technical result is achieved by the GBS fabricated with the protruding part and it means the following. The protruding part adds to buoyancy of the GBS and the entire structure, as well as reduces its submersion during transportation to the installation site. Additional ballast compartments in the peripheral part of the GBS inside the protruding part make it easy to balance the GBS, i.e. to settle the GBS down evenly, without trim and list. Increased width of the GBS lower part adds to stability of the entire structure during its transportation, enabling to install the topside structure of greater height and weight onto the GBS.

Unlike platforms that are installed and towed in deepwater areas, the GBS that uses the protruding part instead of having the same volume across its height has a tangible advantage in terms of the draft and the overall weight-to-floatability ratio, which enables a much greater displacement for a relatively modest increase in the platform's own weight.

The protruding part of the GBS also protects the central part, which can accommodate main storage compartments, from drifting ice and emergency ship impact.

Erecting both side walls and short-end walls before the top slab is formed as well as having possibility to assemble the tanks from separate panels in a confined compartment helps to accelerate the GBS fabrication and to reduce the number of "cold welds" in the reinforced concrete construction.

To reduce the overall GBS production time, certain stages are carried out in parallel.

LIST OF DRAWINGS

FIG. 1 shows fabrication of the base slab and walls of the GBS central part between the base slab and the intermediate slab.

Figure 2:
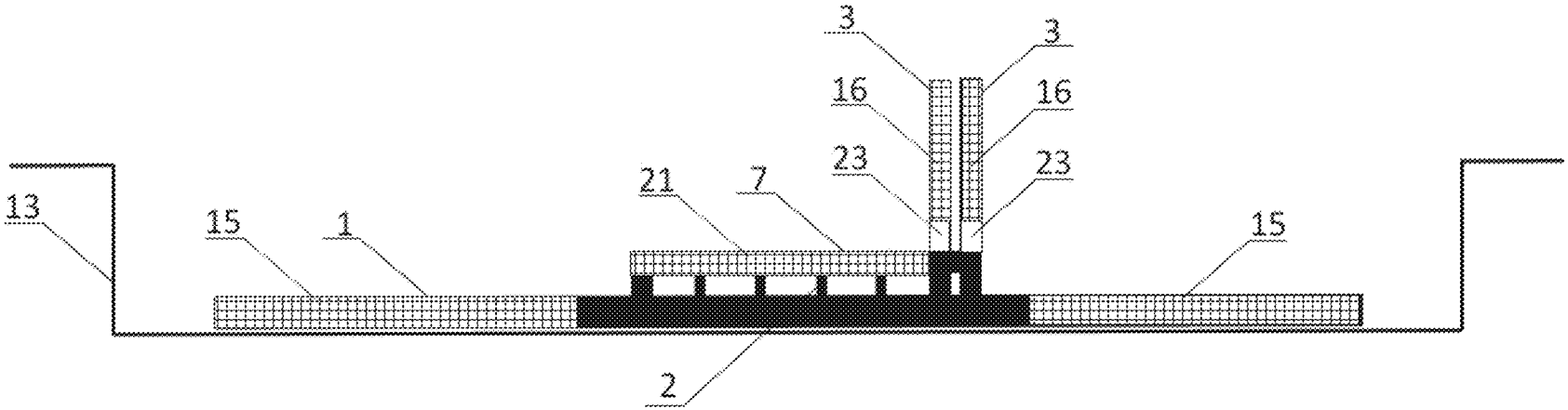

FIG. 2—fabrication of the base slab and intermediate slab as well as inner walls of the GBS central part.

Figure 3:
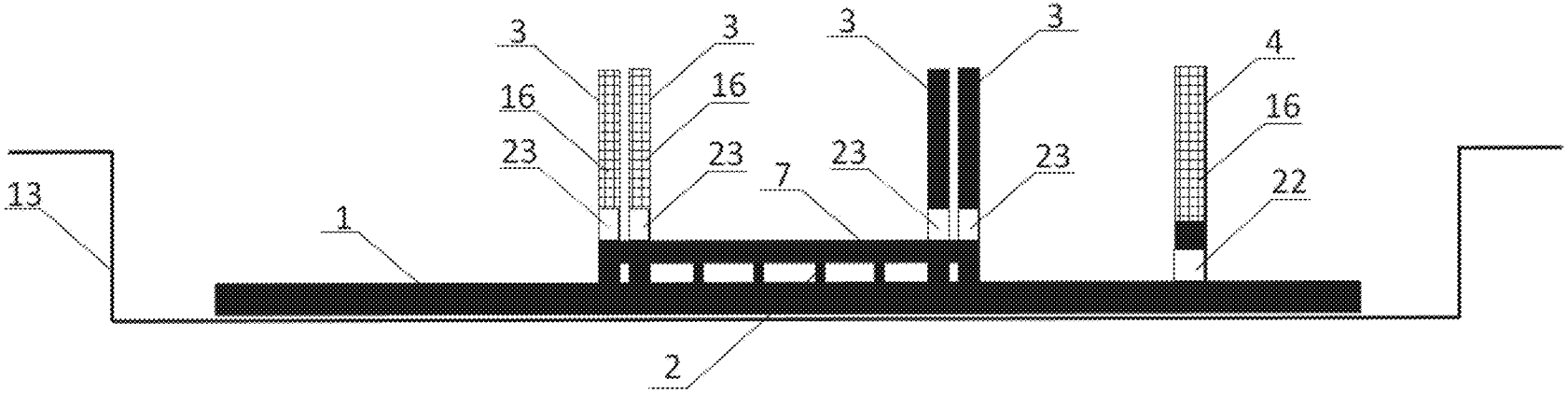

FIG. 3—fabrication of the inner and outer walls of the GBS central part.

Figure 4:
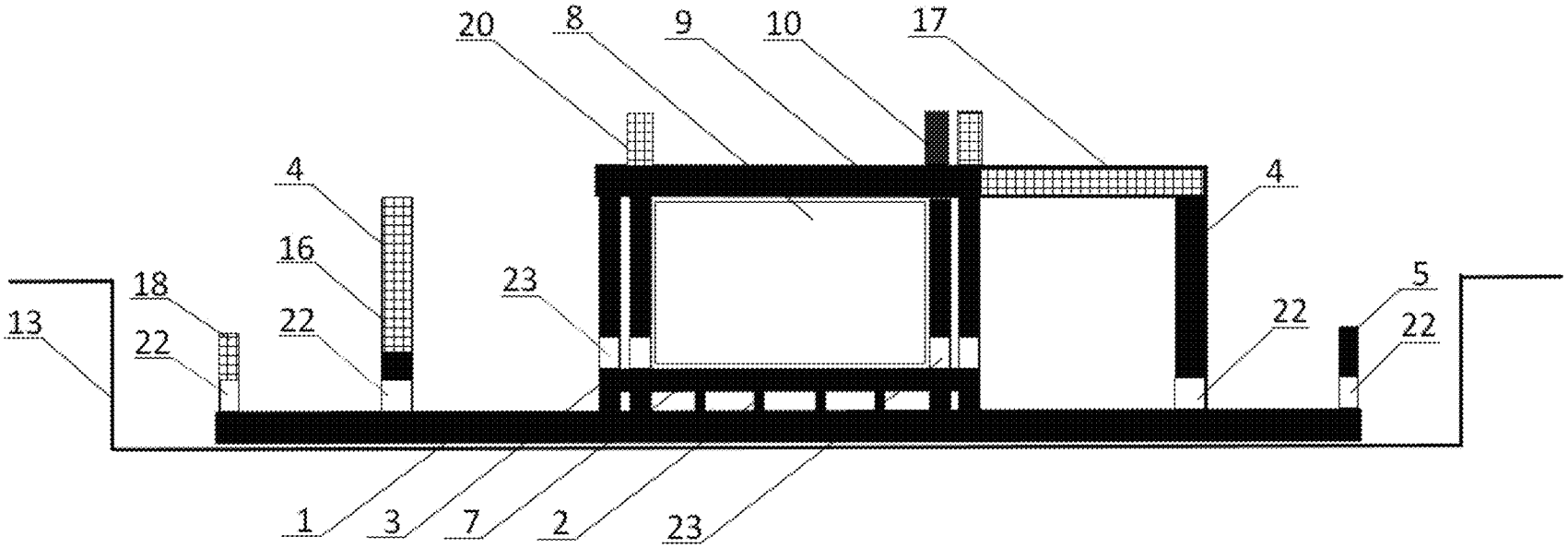

FIG. 4—fabrication of the outer walls of the GBS central part, top slab, topside supports on the top slab, outer walls of the GBS protruding part and tanks for liquids storage inside the GBS.

Figure 5:
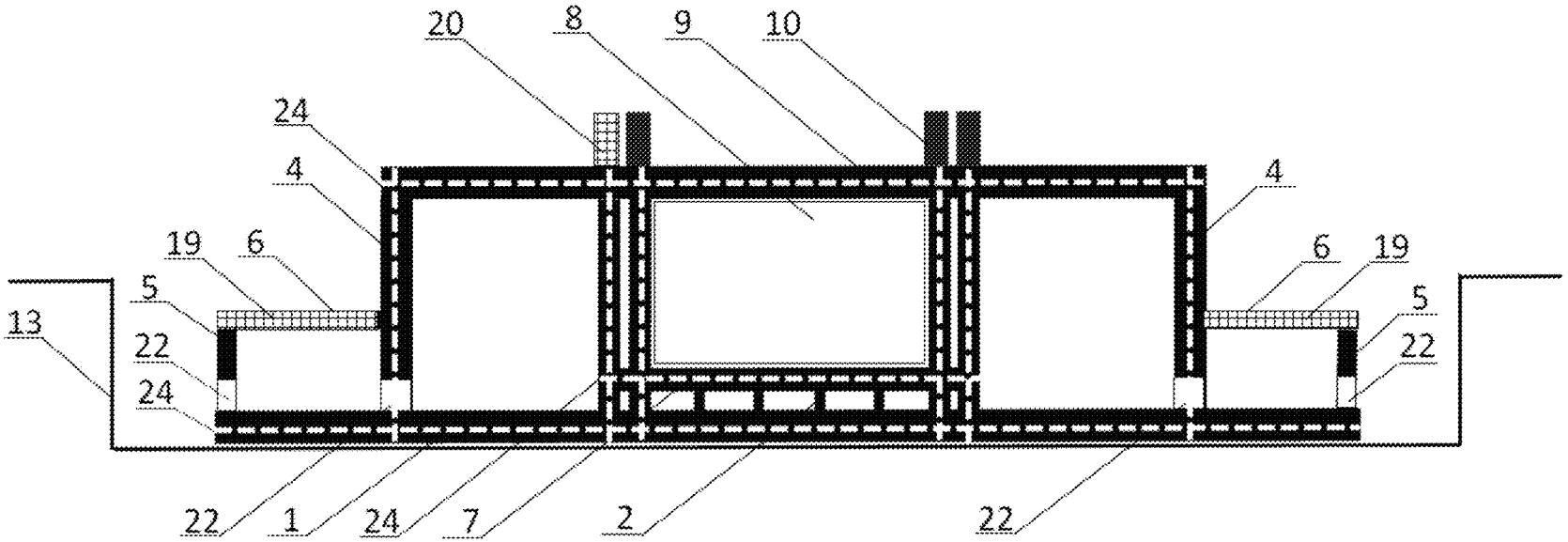

FIG. 5—fabrication of the top slab of the GBS central part, top slab of the GBS protruding part and top structure supports.

Figure 6:
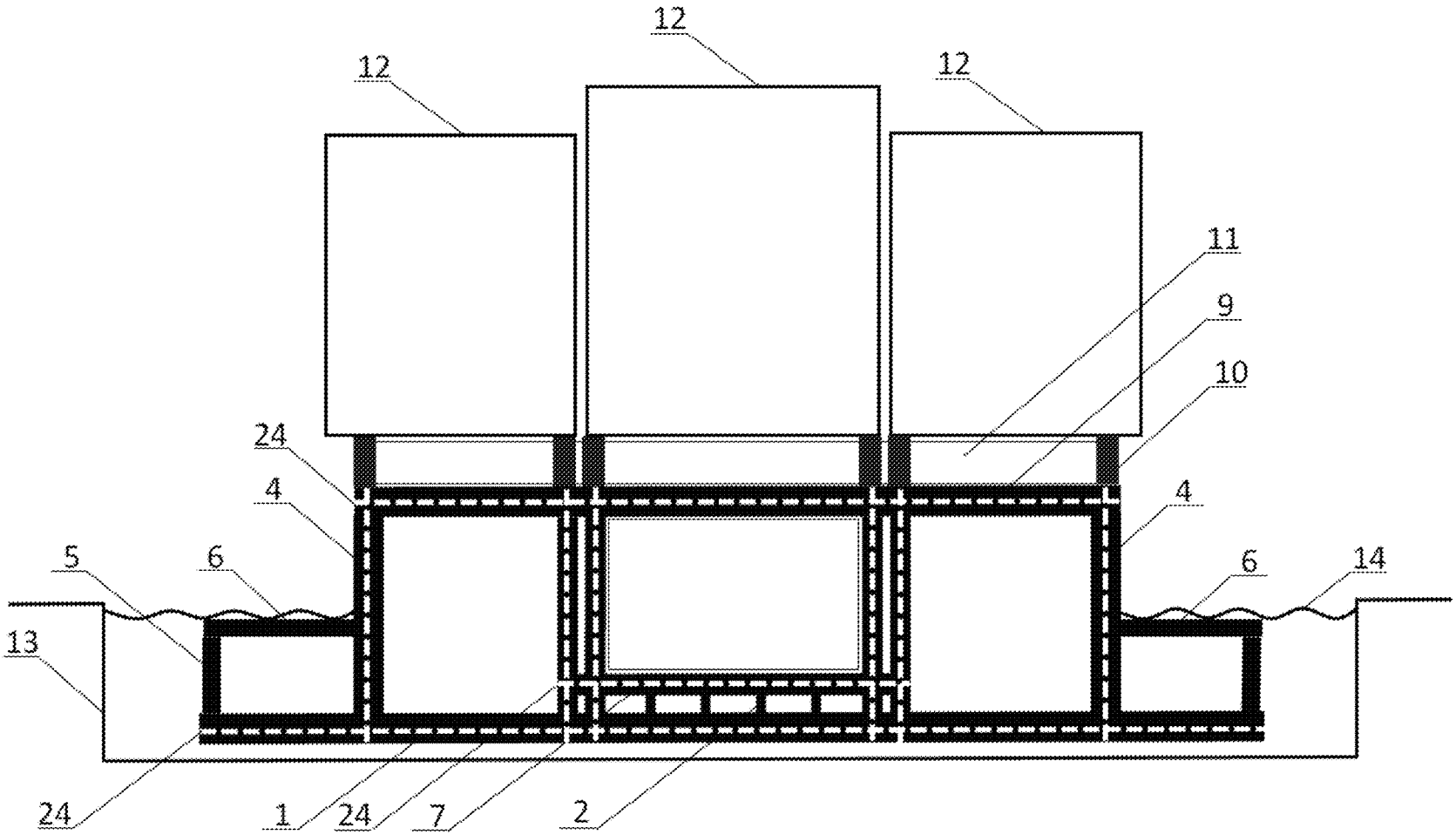

FIG. 6—the fabricated GBS when towed out of a dock, front view.

Figure 7:
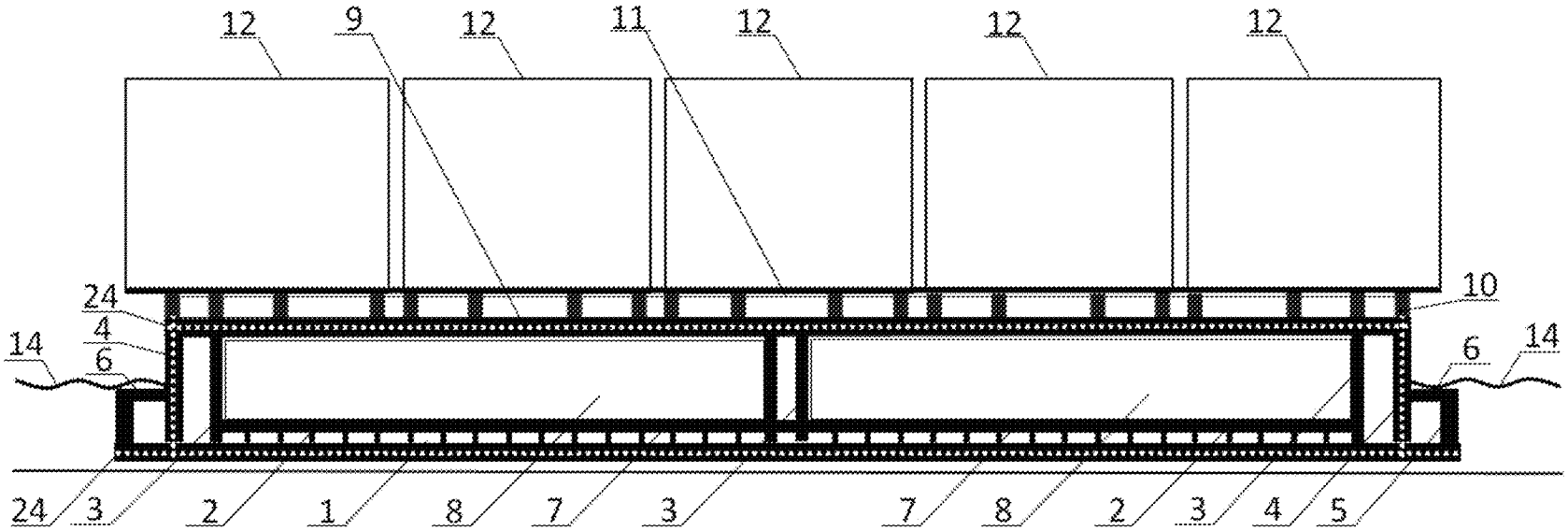

FIG. 7—the fabricated GBS when towed out of the dock, side view.

EXAMPLES OF THE INVENTION IMPLEMENTATION

The production program implies mass production of GBSs as part of a staged process at a specialized fabrication site with dry docks. The location of the fabrication site facilities allows producing materials for every separate stage of fabrication within limits of a separate facility with subsequent transportation to dry docks for use in the GBS fabrication. The GBS fabrication sequence is designed to optimize the use of equipment and personnel and reduce construction time through parallel performance of part of the work stages.

The GBS is fabricated as follows.

The dry dock is isolated from the adjacent water area using a dock gate, then the dock is drained with pumps. Then, at the bottom of the dock, an area with a cover of compacted crushed rock is prepared for fabrication of the GBS foundation slab.

Reinforcement is cut and bent and reinforcement cages are fabricated and labelled in a reinforcement shop. Reinforcement elements are transported to the dry dock by road and fed at the GBS reinforcement cage assembly site with loaders or lifting cranes. The GBS reinforcement cage is assembled by welding, lashing, and sleeving.

Simultaneously with the reinforcement cage, duct tubes for bundles of post-tensioning reinforcement strands are installed in the tensioned structures, as well as the anchors and embedments for equipment to be installed.

Three types of formworks are used for the GBS concreting: traditional formwork, inventory formwork and permanent formwork. In a formwork shop, traditional and permanent formwork is produced, and inventory formwork assembly sections are assembled. Completed sections are stored in a formwork laydown area and, when needed, they are transported to the dry dock and installed for concreting of the GBS structure.

Traditional formwork panels are produced from cut wood and laminated plywood in the formwork shop. The traditional formwork is used to concrete objects of smaller height, mainly for slabs and supports.

Basic elements of the inventory formwork are panels or blocks, frames, bearing structures, connectors and fastenings. Depending on the structure to be concreted, two types of inventory formwork are applied: panel-type formwork and slipforming.

Panel-type formwork is collapsible and consists of large-sized elements, accelerating construction of large-scale objects. Slipforming consists of two identical rows of panels, 1.0-1.2 m high, rigidly connected to one another by bolts and attached to a special frame, which is moved upwards by jacks along with the structure's concreting process. Slipforming is used for the GBS walls concreting. With slipforming applied, concreting is monolithic, that is, without the "cold seams", thus improving the structure's performance parameters. Moreover, the use of slipforming enables the GBS walls to be concreted very fast-over 2.5 meters upwards per day.

Permanent formwork is used when formwork removal is impossible, e.g. during concreting of the intermediate ceiling slab when the equipment is installed inside the compartment. This type of formwork is also used for construction of pit structures in LNG tanks and other parts of the GBS, removal of which is labor-intensive after closure of outer structures.

Concrete, which is the main construction material for GBS production, is mixed at a concrete batching plant, located close to the dry docks. Location of the concrete batching plant ensures the least distance for concrete to be transported to the pouring point.

Bulk materials for concrete mixing may be delivered to the fabrication site via a quay, located in front of the concrete batching plant, and it secures the shortest way for the materials from the offloading point to the place where they are stored and consequently used.

The GBS production employs special concrete mix designs of high strength, having the pre-requisite density and durability features. The use of concrete of different densities in combination with weight control allows to achieve optimal targets for mass, buoyancy and stability of the structure. The concrete mix is delivered to the dry dock by truck mixers. The concrete is poured into the formwork with concrete pumps.

Concreting starts with sectionalized concrete casting of the base slab 1, which is common for the GBS central and protruding parts (FIG. 1). A reinforcement cage is assembled for the rectangular base slab 1, a formwork for the base slab 1 is installed and the base slab 1 is then concreted. As individual sections of the base slab 1 are completed, reinforcement cages are assembled in the central part of the GBS for internal walls 2 with the help of an inventory formwork. In parallel, installation of reinforcement cages 16 is performed for internal walls 3 and external walls 4 in the GBS central part (FIG. 2, 3), which are slipformed. During this process, the GBS central part is shaped as a rectangular prism. For the purposes of formwork removal and subsequent equipment installation in GBS compartments, relatively small service openings 22 are left in the walls to be further thoroughly closed and sealed once the work inside the compartments is finished.

In case the GBS is fabricated with an intermediate slab 7 to accommodate at least one liquid storage tank 8 (FIG. 4), as concreting of individual sections of the walls 2 of the central part between the base slab 1 and intermediate slab 7 is completed, concreting of the GBS intermediate slab 7 begins, in parallel with concreting of the internal and external walls 3 and 4 in the GBS central part. For this purpose, a reinforcement cage 21 is assembled, formwork is erected and the intermediate slab 7 is concreted.

As individual sections of the external walls 4 of the central part are concreted, a reinforcement cage 18 is assembled, formwork is installed, and external and internal walls of the protruding part are concreted section by section, using slipforming. The external walls 5 of the GBS protruding part are erected all along the base slab perimeter, with the external walls 5 of the protruding part being lower than the external walls 4 of the central part.

In parallel, in the sections where concreting of walls 3, 4 of the GBS central part is completed, concreting of the top slab 9 of the GBS central part begins. For this purpose, a reinforcement cage 17 is assembled for the top slab 9, formwork is erected for the top slab 9 and the top slab 9 is concreted. In addition, to erect the formwork, the scaffolding and trestles are installed inside the GBS compartments allowing the use of roof beams to be avoided. Using scaffolding in combination with the formwork provides their universal usage both for building the top slab 9 and for performing subsequent preparation and installation of structural elements of tanks 8 at different heights, which ultimately results in overall construction acceleration.

To offset the downward bending of the top slab 9 due to its weight, the central part of the slab is bent upwards before concreting to ensure camber in the opposite direction. Once the concreting is completed and the formwork is removed, the slab settles down due to its weight and takes design configuration enabling partial offset of downward bending. Using a beamless design for the top slab 9 with uneven thickness similar to an arc where the slab is thicker near its edges than in the span (not shown in the drawings) enables better target specifications for weight and rigidity as well as accelerated formwork installation through simplification of the slab bottom surface, which has no protruding parts.

At least in one of the compartments formed by internal reinforced concrete walls 3, intermediate slab 7 and top slab 9, the liquid storage tank 8 is locally erected from panels delivered through openings 23 in the walls.

In parallel, as the external walls 5 of the GBS protruding part are completed, concreting of top slabs 6 of the GBS protruding part begins (FIG. 4, 5). The top slabs 6 of the GBS protruding part are connected to the external walls 4 of the central part by extending and tying protruding ends of reinforcement cage 19 into sleeves and anchor rods that were earlier flush-mounted during slipforming of walls 4 in accordance with the design.

If the intended use of the GBS includes berthing of vessels, supports are built from reinforced concrete along the outer edge of the GBS protruding part above the top slab 6 for the purpose of installation of berthing structures and fenders for berthing and mooring of vessels enabling the use of GBS structures as a berth. These supports are erected with the help of an inventory formwork.

Should it be required to fabricate a GBS with supports 10 for a topside equipment to be installed on the top slab 9, then a reinforcement cage 20 is assembled, formwork is installed, embedments are set in and the supports 10 are concreted to provide support for load-bearing structures of the topside cages which may house process equipment (FIG. 5).

The post-tensioning materials workshop accommodates storage of reinforcement strands 24, duct tubes and anchors, preparation of materials and equipment to perform post-tensioning. In the areas where sequence of works makes it possible to start this type of work, the equipment is installed in the dry dock. Once the equipment is ready, the post-tensioning materials are transported to the dry dock where strand bundles are installed and tensioned to the design values with anchoring and transmission of tensioning force to anchoring devices on reinforced concrete structures of the GBS.

Concrete structures are post-tensioned using "tension on concrete" with bonding restoration, which means that after the concrete of the tensioned reinforced concrete structures of the GBS is poured, reinforcement strands 24 are forced/pulled through the pre-installed duct tubes made of corrugated steel. After the concrete has reached the minimum required strength, the strand bundles are tensioned and fixed thus transmitting the tensioning force to steel anchoring devices pre-installed onto the short ends of the structure body. Reinforcement strands 24 are tensioned with hydraulic jacks. After strand bundles are tensioned and pull-out testing is done, the duct tubes are filled with nonshrink cement mortar and all temporary openings and niches are filled up. The duct tubes will protect the reinforcement strands from external impact and partially transfer load from the strands to the concrete along the entire length of the structure.

With post-tensioning during GBS construction, the targeted performance can be achieved more efficiently, especially for limit states group II, such as crack resistance and impermeability. As a result, it reduces the amount of non-tensioned reinforcement required and contributes to reducing the structure weight, as well as increases the overall spatial stiffness of the load-bearing reinforced concrete cage of the GBS.

Closing of process openings 22, 23 in the GBS walls, concreting of post-tension anchors, and cleaning of concrete surface take place in the end.

After the GBS fabrication is complete, equipment 11 is installed inside compartments and on the top slab 9 and a modular topside structure 12 is installed onto the supports 10 on the top slab 9 (see FIGS. 6 and 7). Topside modules 12 may be fabricated in parallel and independently of the GBS construction schedule, and then installed on the supports 10 with the help of a specialized jacking and skidding system. The supports 10 are also the main load-carrying elements supporting the bearing guardrails of the topsides skidding system.

Besides the skidding system, cranes are also used in the dry docks, allowing to install heavy equipment and steel structures onto the GBS from the area near the dock.

After the GBS construction and equipment installation are complete, the dry dock 13 with the GBS inside is gradually filled with water 14 from the nearby water area with the help of pumps. At each stage of the dock flooding, GBS compartments are checked for leak tightness by hydraulic and pneumatic tests. Along with the dock flooding, GBS ballast compartments are flooded as well, to increase the structure's weight and thus ensure its steadiness on the dock bottom.

Once tests are complete, GBS is fixed inside the dock with mooring hawsers and retention and guiding dolphins located at the bottom of the dry dock. Once GBS testing and mooring is complete, water is pumped out of the compartments of the moored GBS to ensure its floating up during the high tide.

The GBS is towed out of the dock by tugboats. After being towed out of the dry dock, the GBS is towed to the installation site. By the onshore winches and by tugs, the GBS is installed in the point of destination at a quayside, where the GBS is connected to onshore communication lines in the deposit area. Once its position is confirmed as correct, the GBS is ballasted to be installed onto a foundation, previously arranged in the bottom of a water body.

The invention claimed is:

1. A method for fabricating a gravity-based structure (GBS), comprising:

assembling a first reinforcement cage for a rectangular base slab, installing a first formwork and then concreting the base slab, assembling, as separate sections of the base slab are concreted, second reinforcement cages for inner walls and outer walls and concreting the inner walls and the outer walls by slipforming, assembling, as separate wall sections are concreted, a third reinforcement cage for a main top slab, installing a second formwork and then concreting the main top slab, and post-tensioning with reinforcement strands the main top slab and the base slab, as well as the inner walls and the outer walls, wherein the GBS is fabricated including a central part and protruding part that have the common base slab, besides the inner walls and the outer walls as well as the main top slab are concreted for the central part of GBS, that takes form of a rectangular prism, as separate sections of the outer walls of the central part are concreted, a fourth reinforcement cage is assembled, a third formwork is installed and concreting is performed for the inner walls and the outer walls of the GBS protruding part, the outer walls of the GBS protruding part are made along a perimeter of the base slab, and at the same time a height of the outer walls of the protruding part is lower than a height of the outer walls of the central part, as separate wall sections of the protruding part are concreted, a fifth reinforcement cage is assembled and a fourth formwork is installed for an additional top slab of the protruding part and then concreted, and the base slab and the main top slab, as well as the inner walls and the outer walls of the central part and protruding part are post-tensioned as the main top slab and the additional top slab are concreted and the concrete of the post-tensioned structures is cured.

2. The method according to claim 1, wherein the main top slab is concreted with upward bending of a central part of the main top slab so that the central part of the main top slab lowers on its own weight to a design position.

3. The method according to claim 1, wherein, as soon as separate sections of the main top slab are concreted, a sixth reinforcement cage is assembled, a fifth formwork is installed, embedments are set and supports for equipment are concreted on the main top slab.

4. The method according to claim 1, wherein, in the course of the inner walls and the outer walls of the central part being concreted, openings are left for formwork removal and further installation of equipment inside GBS compartments shaped by the inner walls and the outer walls of the central part and the main top slab and the base slab.

5. The method according to claim 3, wherein, simultaneously with concreting of the inner walls and the outer walls of the central part, a seventh reinforcement cage is assembled, a sixth formwork is installed and an intermediate slab is concreted, post-tensioned, and inside at least one compartment shaped by the inner walls and the outer walls of the central part, the intermediate slab and the main top slab, a tank for storage of liquids is arranged with panels, delivered through temporary wall openings.

* * * * *